US012723388B2

(12) United States Patent
Lei

(10) Patent No.: US 12,723,388 B2
(45) Date of Patent: Sep. 1, 2026

(54) BASIN KITCHEN FAUCET WITH INTEGRATED SOAP DISPENSER

(71) Applicant: Shike Lei, Hunan Province (CN)

(72) Inventor: Shike Lei, Hunan Province (CN)

( * ) Notice: Subject to any disclaimer, the term of this patent is extended or adjusted under 35 U.S.C. 154(b) by 177 days.

(21) Appl. No.: 18/755,634

(22) Filed: Jun. 26, 2024

(65) Prior Publication Data

US 2025/0263913 A1 Aug. 21, 2025

(30) Foreign Application Priority Data

Feb. 20, 2024 (CN) ..... 202420316351.2

(51) Int. Cl.
*E03C 1/04* (2006.01)
*E03C 1/046* (2006.01)

(52) U.S. Cl.
CPC ..... *E03C 1/046* (2013.01); *E03C 1/0404* (2013.01)

(58) Field of Classification Search
CPC ..... E03C 1/04; E03C 1/0403; E03C 1/0404; E03C 1/0412; E03C 1/046; E03C 1/0465
See application file for complete search history.

(56) References Cited

U.S. PATENT DOCUMENTS 5,114,048 A * 5/1992 Minke ..... E03C 1/04 222/135
6,718,568 B1 * 4/2004 Hensley ..... E03C 1/04 4/677
6,827,294 B1 * 12/2004 Fan ..... E03C 1/057 239/289
2008/0256702 A1 * 10/2008 Yeh ..... E03C 1/04 4/675

FOREIGN PATENT DOCUMENTS

CN 207500572 U * 6/2018 ..... F16K 27/00
CN 214194792 U * 9/2021 ..... E03C 1/046
CN 220228047 U * 12/2023 ..... A47K 5/1202
GB 2136923 A * 9/1984 ..... A47K 5/1202

* cited by examiner

*Primary Examiner* — Darren W Gorman
(74) *Attorney, Agent, or Firm* — Nicholas Makridakis

(57) ABSTRACT

A basin kitchen faucet with integrated soap dispenser is disclosed, including a main body. The main body is provided with a soap cavity, a fluid passage, and a switch module for controlling water flow through. A water outlet component is connected to an upper end of the fluid passage and a water inlet component is connected to a lower end of the fluid passage. The soap cavity is internally installed a soap press pump module. The soap press pump module includes a soap switch, a jacket, a button, a soap outlet pipe, and a nut. During getting water by using the water outlet component, the soap switch can be squeezed to pump out soap from the soap cavity, it is easy to use.

7 Claims, 3 Drawing Sheets

BASIN KITCHEN FAUCET WITH INTEGRATED SOAP DISPENSER

TECHNICAL FIELD

The present application relates to the technical field of faucets, and in particular to a basin kitchen faucet with integrated soap dispenser.

BACKGROUND

Faucets are widely used in both domestic and commercial places, and their common uses include hand washing, vegetable washing, bathing, face washing and so on. With development of science and technology, modern faucets also have functions of water saving, filtration and cleaning to meet different needs of users for faucets. Selection of the faucets should take into account factors such as place of use, style, function and quality to ensure its use effect and durability.

In addition to basic cleaning function, in a modern use of scene, the faucets also need to be integrated with some other functions, such as when in use of the faucets, a user may always take a cleanser (soap) to clean tableware, thereby cleaning surfaces of the tableware more effectively. Thus there is an urgent need for an integrated faucet structure, and in design of such faucet, it is also necessary to take into account convenience of adding soap and the soap may be observed at any time in order to add the soap timely.

SUMMARY

The present disclosure aims to provide a basin kitchen faucet with integrated soap dispenser to address problems mentioned in above background.

To achieve above objectives, the present disclosure adopts following technical solutions. In some embodiments of the present disclosure, a basin kitchen faucet with integrated soap dispenser is provided, including a main body, the main body is provided with a soap cavity for storing soap, a fluid passage for allowing water to pass through, and a switch module for controlling water flow through. A water outlet component is connected to an upper end of the fluid passage and a water inlet component is connected to a lower end of the fluid passage, and the soap cavity is internally installed a soap press pump module.

The soap press pump module includes a soap pump, a jacket, a button, a soap outlet pipe, and a nut. The jacket is mounted at a port of the soap cavity, the jacket is provided with a sliding cavity that allows the button to slide up and down, and the jacket is provided with a sliding groove on a pipe wall thereon for the soap outlet pipe to slide up and down. The button is disposed in the sliding cavity of the jacket, the soap outlet pipe is mounted to connect with the button and one end of the soap outlet pipe extends from the sliding groove, and a bottom of the button is fixedly connected to the soap pump through the nut.

In some preferred embodiments of the present disclosure, the soap press pump module further includes a soap inlet pipe, the soap inlet pipe is connected to a lower end of the soap switch, and a lower end of the soap inlet pipe is connected to a soap bottle. The soap inlet pipe is provided with a soap check valve.

In some preferred embodiments of the present disclosure, the switch module is fixedly connected to a side of the main body and interconnected with the fluid passage. The switch module includes a valve core sleeve, a valve core seat fixedly connected to an inside of the valve core sleeve, and a water flow valve core fixedly connected to the valve core seat. The water flow valve core is fixedly connected with a gland around an end thereon, the gland is sleeved with an O-ring, and the water flow valve core is fixedly connected with a handle at a top of the end thereon.

In some preferred embodiments of the present disclosure, the water inlet component includes a base threaded into a bottom of the main body, and a corrugated tube threaded into the base and extending downward. A sealing ring is fixedly connected between the corrugated tube and the base, and the corrugated tube is sleeved with a rubber gasket, an iron ring, and an opening nut around a periphery thereon from top to bottom.

In some preferred embodiments of the present disclosure, the water outlet component is connected to the fluid passage by means of a pipe joint. The water outlet component includes a water outlet pipe and a water outlet nozzle, the water outlet nozzle is fixedly connected to an outlet of the water outlet pipe, and an inlet of the water outlet pipe is fixedly connected with the pipe joint so as to connect with the fluid passage.

In some preferred embodiments of the present disclosure, water inlet component further includes two inlet pipes arranged side-by-side, and two quick pipes arranged side-by-side, each of the inlet pipes and the quick pipes is connected to a lower end of the fluid passage and in communication with the fluid passage.

In some preferred embodiments of the present disclosure, the pipe joint is provided with several rubber rings.

Compared with existing technologies, the basin kitchen faucet with integrated soap dispenser of the present disclosure has at least following advantages and beneficial effects.

When in use of the basin kitchen faucet with integrated soap dispenser of the present disclosure, during getting water by using the water outlet component, the soap switch can be squeezed to pump out soap from the soap cavity, and then the soap is flowed out of the soap outlet pipe to achieve acquisition of the soap, which is easy to use, thereby improving comprehensive utilization of kitchen appliances.

The basin kitchen faucet with integrated soap dispenser of the present disclosure, by integrating soap functional modules into the main body, which can improve integration of whole faucet, reduce an area of indoor space used, and also reduce installation cost and installation time.

BRIEF DESCRIPTION OF THE DRAWINGS

In order to more clearly illustrate the technical solutions in the embodiments of the present disclosure or in the existing technologies, the following will be briefly described accompanying drawings used in the embodiments or the existing technologies. It is obvious that following described accompanying drawings is only a part of the embodiments of the present disclosure, and for a person of ordinary skill in the art, other accompanying drawings may be obtained based on these drawings without creative labor.

Figure 1:
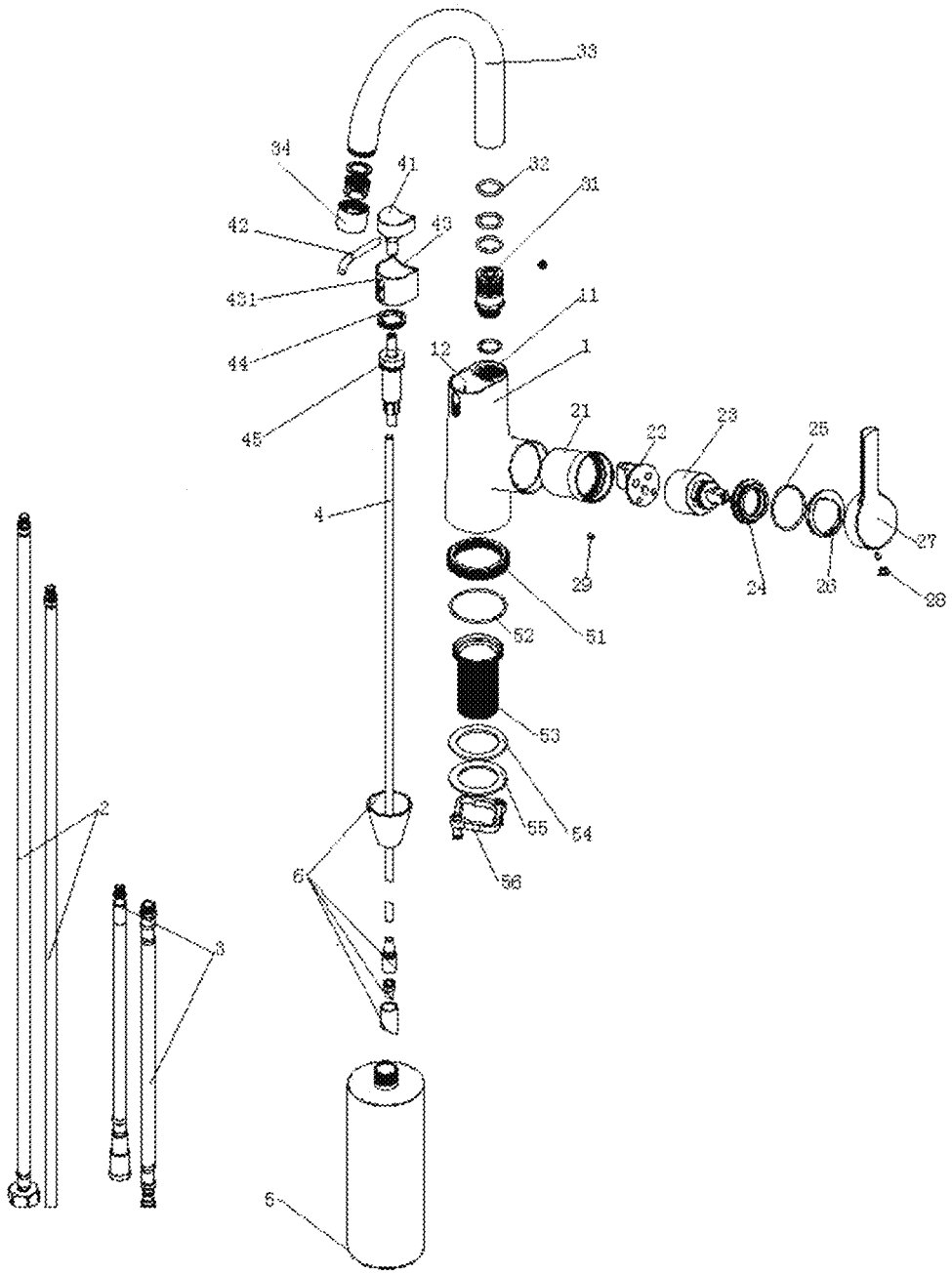
FIG. 1 shows an exploded view of an overall structure of a basin kitchen faucet with integrated soap dispenser in accordance with some embodiments of the present disclosure.

In the drawings, reference signs are as follows. 1. Main body, 2. Inlet pipe, 3. Quick pipe, 4. Soap inlet pipe, 5. Soap bottle, 6. Soap check valve, 11. Fluid passage, 12. Soap cavity, 21. Valve core sleeve, 22. Valve core seat, 23. Water flow valve core, 24. Gland, 25. O-ring, 26. Decorative part, 27. Handle, 28. First stop pin, 29. Second stop pin, 31. Pipe joint, 32. Rubber ring, 33. Water outlet pipe, 34. Water outlet nozzle, 41. Button, 42. Soap outlet pipe, 43. Jacket, 431. Sliding groove, 44. Nut, 45. Soap switch.

DETAILED DESCRIPTION OF THE EMBODIMENTS

The technical solutions in the embodiments of the present disclosure will be described clearly and completely below in conjunction with the accompanying drawings in the embodiments of the present disclosure. It is obvious that the described embodiments are only a part of the embodiments of the present disclosure and not all of the embodiments. Based on the embodiments of the present disclosure, all other embodiments obtained by the person of ordinary skill in the art without creative labor shall within the scope of protection of the present disclosure.

Figure 2:
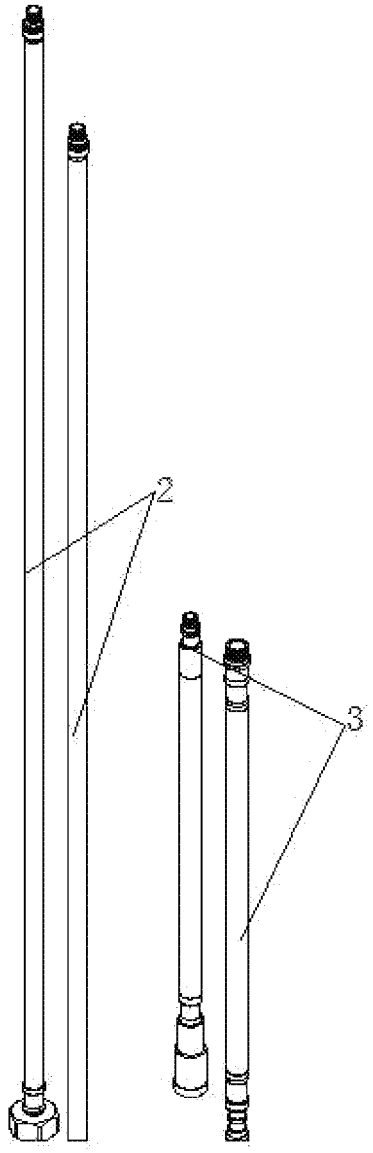
FIG. 2 shows a schematic diagram of two inlet pipes and two quick pipes in accordance with some embodiments of the present disclosure.

As shown in FIG. 1 and FIG. 2, in some embodiments of the present disclosure, a basin kitchen faucet with integrated soap dispenser is provided, including a main body 1. Herein the main body 1 is provided with a soap cavity 12 for storing soap, a fluid passage 11 for allowing water to pass through, and a switch module for controlling water flow through. A water outlet component is connected to an upper end of the fluid passage 11 and a water inlet component is connected to a lower end of the fluid passage 11, and the soap cavity 12 is internally installed a soap press pump module.

The soap press pump module includes a soap pump 45, a jacket 43, a button 41, a soap outlet pipe 42, and a nut 44. The jacket 43 is mounted at a port of the soap cavity 12, the jacket 43 is provided with a sliding cavity that allows the button 41 to slide up and down, and the jacket 43 is provided with a sliding groove 431 on a pipe wall thereon for the soap outlet pipe 42 to slide up and down, the button 41 is disposed in the sliding cavity of the jacket 43, the soap outlet pipe 42 is mounted to connect with the button 41 and one end of the soap outlet pipe 42 extends from the sliding groove 431, and a bottom of the button 41 is fixedly connected to the soap pump 45 through the nut 44.

In the embodiments of the present disclosure, the soap press pump module further includes a soap inlet pipe 4, the soap inlet pipe 4 is connected to a lower end of the soap switch 45, and a lower end of the soap inlet pipe 4 is connected to a soap bottle 5. Furthermore, the soap inlet pipe 4 is provided with a soap check valve 6.

In the embodiments of the present disclosure, the switch module is fixedly connected to a side of the main body 1 and interconnected with the fluid passage 11. The switch module includes a valve core sleeve 21, a valve core seat 22 fixedly connected to an inside of the valve core sleeve 21, and a water flow valve core 23 fixedly connected to the valve core seat 22. The water flow valve core 23 is fixedly connected with a gland 24 around an end thereon, the gland 24 is sleeved with an O-ring 25, and the water flow valve core 23 is fixedly connected with a handle 27 at a top of the end thereon.

During a specific installation, a decorative part 26 is also provided between the gland 24 and the handle 27, where the handle 27 is fixedly connected to the water flow valve core 23 through a first stop pin 28, and the water flow valve core 23 is fixedly connected to the valve core sleeve 21 through a second stop pin 29.

In the embodiments of the present disclosure, the water inlet component includes a base 51 threaded into a bottom of the main body 1, and a corrugated tube 53 threaded into the base 51 and extending downward. A sealing ring 52 is fixedly connected between the corrugated tube 53 and the base 51, and the corrugated tube 53 is sleeved with a rubber gasket 54, an iron ring 55, and an opening nut 56 around a periphery thereon from top to bottom.

In the embodiments of the present disclosure, the water inlet component further includes two inlet pipes 2 arranged side-by-side, and two quick pipes 3 arranged side-by-side, each of the inlet pipes 2 and the quick pipes 3 is connected to a lower end of the fluid passage 11 and in communication with the fluid passage 11.

In the embodiments of the present disclosure, the water outlet component is connected to the fluid passage 11 by means of a pipe joint 31. The water outlet component includes a water outlet pipe 33 and a water outlet nozzle 34, the water outlet nozzle 34 is fixedly connected to an outlet of the water outlet pipe 33, and an inlet of the water outlet pipe 33 is fixedly connected with the pipe joint 31 so as to connect with the fluid passage 11.

In the embodiments of the present disclosure, the pipe joint 31 is provided with several rubber rings 32.

Figure 3:
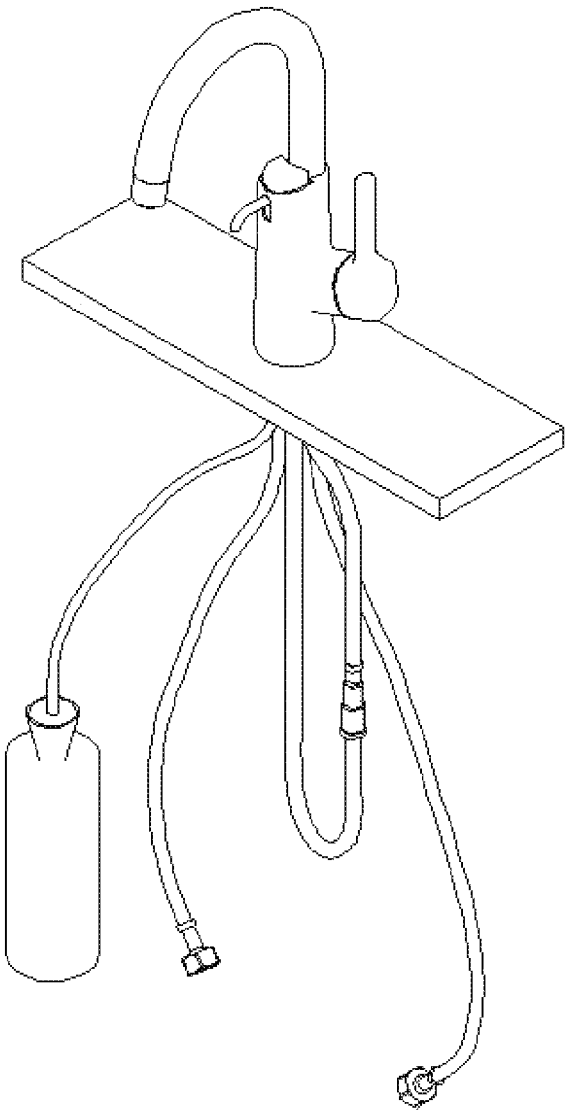
FIG. 3 shows a schematic diagram of an installation structure of the basin kitchen faucet with integrated soap dispenser in accordance with some embodiments of the present disclosure.

Referring to FIG. 3, when in use of the basin kitchen faucet with integrated soap dispenser of the present disclosure, during getting water by using the water outlet component, the soap switch 45 can be squeezed to pump out soap from the soap cavity 12, and then the soap is flowed out of the soap outlet pipe 42 to achieve acquisition of the soap, which is easy to use, thereby improving comprehensive utilization of kitchen appliances.

The basin kitchen faucet with integrated soap dispenser of the present disclosure, by integrating soap functional modules into the main body 1, which can improve integration of whole faucet, reduce an area of indoor space used, and also reduce installation cost and installation time.

Based on the embodiments of the present disclosure, all other embodiments obtained by the person of ordinary skill in the art without creative labor, any modifications, equivalent substitutions, improvements, and the like made shall be included in the scope of protection of the present disclosure.

What is claimed is:

1. A basin kitchen faucet with integrated soap dispenser, comprising a main body, the main body is provided with a soap cavity for storing soap, a fluid passage for allowing water to pass through the main body, and a switch module for controlling water flow through the main body;

wherein a water outlet component is connected to an upper end of the fluid passage and a water inlet component is connected to a lower end of the fluid passage, and a soap press pump module is installed internally within the soap cavity; and wherein the soap press pump module comprises a soap pump, a jacket, a button, a soap outlet pipe, and a nut; the jacket is mounted at a port of the soap cavity, the jacket is provided with a sliding cavity that allows the button to slide up and down, and the jacket is provided with a sliding groove on a pipe wall thereon for the soap outlet pipe to slide up and down, the button is disposed in the sliding cavity of the jacket, the soap outlet pipe is mounted to connect with the button and one end of the soap outlet pipe extends from the sliding groove, and a bottom of the button is fixedly connected to the soap pump through the nut.

2. The basin kitchen faucet with integrated soap dispenser according to claim 1, wherein the switch module is fixedly connected to a side of the main body and interconnected with the fluid passage; wherein the switch module comprises a valve core sleeve, a valve core seat fixedly connected to an inside of the valve core sleeve, and a water flow valve core fixedly connected to the valve core seat; and wherein the water flow valve core is fixedly connected with a gland around an end thereon, the gland is sleeved with an O-ring, and the water flow valve core is fixedly connected with a handle at a top of the end thereon.

3. The basin kitchen faucet with integrated soap dispenser according to claim 2, wherein the water inlet component comprises a base threaded into a bottom of the main body, and a corrugated tube threaded into the base and extending downward; and wherein a sealing ring is fixedly connected between the corrugated tube and the base, and the corrugated tube is sleeved with a rubber gasket, an iron ring, and an opening nut around a periphery thereon from top to bottom.

4. The basin kitchen faucet with integrated soap dispenser according to claim 3, wherein the water outlet component is connected to the fluid passage by means of a pipe joint, the water outlet component comprises a water outlet pipe and a water outlet nozzle, the water outlet nozzle is fixedly connected to an outlet of the water outlet pipe, and an inlet of the water outlet pipe is fixedly connected with the pipe joint so as to connect with the fluid passage.

5. The basin kitchen faucet with integrated soap dispenser according to claim 4, wherein the pipe joint is provided with several rubber rings.

6. The basin kitchen faucet with integrated soap dispenser according to claim 4, wherein the soap press pump module further comprises a soap inlet pipe, the soap inlet pipe is connected to a lower end of the soap pump, and a lower end of the soap inlet pipe is connected to a soap bottle; and wherein the soap inlet pipe is provided with a soap check valve.

7. The basin kitchen faucet with integrated soap dispenser according to claim 3, wherein the water inlet component further comprises two inlet pipes arranged side-by-side, and two quick pipes arranged side-by-side, each of the inlet pipes and the quick pipes is connected to a lower end of the fluid passage and in communication with the fluid passage.

* * * * *